US005952284A

United States Patent [19]

Finch et al.

[11] Patent Number: 5,952,284

[45] Date of Patent: Sep. 14, 1999

[54] FABRIC TREATMENT COMPOSITIONS

[75] Inventors: Timothy David Finch; Jagshinder Kaur Sahota, both of Wirral, United Kingdom

[73] Assignee: Lever Brothers Company, Division of Conopco, Inc., New York, N.Y.

[21] Appl. No.: 09/005,254

[22] Filed: Jan. 9, 1998

[30] Foreign Application Priority Data

Jan. 10, 1997 [EP] European Pat. Off. ..... 97300123

[51] Int. Cl.[6] ..... C11D 3/30

[52] U.S. Cl. ..... 510/394; 510/504

[58] Field of Search ..... 510/119, 130, 510/504, 394

[56] References Cited

U.S. PATENT DOCUMENTS 5,292,504 3/1994 Cardin et al. ..... 424/70

5,688,996 11/1997 Gutierrez et al. ..... 562/106

5,730,966 3/1998 Torgerson et al. ..... 424/70.11

FOREIGN PATENT DOCUMENTS 0523956 1/1993 European Pat. Off. .

895431 5/1962 United Kingdom .

1387520 3/1975 United Kingdom .

1578288 11/1980 United Kingdom .

OTHER PUBLICATIONS

European Search Report Application No. EP 97/30,0123 dated Jun. 2, 1997.

*Primary Examiner*—John R. Hardee

*Attorney, Agent, or Firm*—Neil Y. Gilbert, Esq.

[57] ABSTRACT

A detergent composition which reduces the photofading of fabric. The detergent composition comprises a cationic UV-absorber and an anionic surfactant.

2 Claims, No Drawings

FABRIC TREATMENT COMPOSITIONS

TECHNICAL FIELD

The present invention relates to fabric washing detergent compositions. In particular, the invention relates to fabric washing detergent compositions containing photofading inhibitors.

BACKGROUND AND PRIOR ART

The fading of coloured fabrics by sunlight during wear and during drying is a major problem for consumers in many parts of the world, thus susceptible fabrics in temperate and high latitude regions in addition to those in the tropics can be severely faded. Sun fading of fabrics is of specific concern to consumers because the contrast between exposed and unexposed areas makes it particularly noticeable. e.g on collars, inside versus outside of garments, and on wrap around garments such as saris. The textile industry has made extensive efforts to develop light stable dyes and after treatments to protect the dyes, however the fading of fabric still remains a problem.

The use of certain sunscreens has already been discussed in the literature. U.S. Pat. No. 4,788,054 (Bernhardt) teaches the use of N-phenylphthalisomides as ultraviolet radiation absorbers for cotton, wool, polyester and rayon. The compositions require an aqueous sulphuric acid vehicle for deposition. Fabric care compositions comprising a water dispersible/water soluble copolymers which prevent photofading are disclosed in EP 0 523 956 (Unilever).

GB 1 387 520 (L'Oreal) discloses formulations that contain derivative of benzylidene-camphor in cosmetic formulations.

However the major problem that needs to be overcome is how to deposit photofading inhibitors onto fabric during the wash using a detergent containing washing system, which is designed to suspend particulate materials and solubilise oils. This problem is particularly exacerbated by the presence of anionic surfactant.

The present invention relates to compositions in which selected photofading inhibitors deposit easily onto fabric during the wash process.

DEFINITION OF THE INVENTION

Accordingly the present invention discloses a detergent composition comprising an anionic surfactant and a cationic UV absorber having the general formula:

Formula I

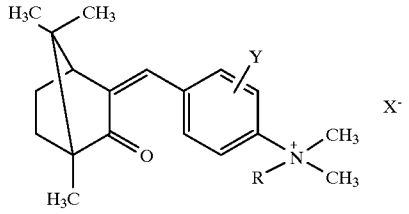

in which R represents a hydrogen atom or an alkyl group containing 1 to 12 carbon atoms and Y represents a halogen atom, a methyl group or a hydrogen atom and $X^-$ any suitable counter ion.

The invention further discloses the use of a cationic sunscreen as described above in a fabric treatment composition such that when said fabric treatment composition is applied to fabric the cationic sunscreen prevents photofading of said fabric.

The invention also relates to a method of preventing the photofading of fabric by treating the fabric with a composition containing a cationic sunscreen as described above.

DETAILED DESCRIPTION OF THE INVENTION

Photofading Inhibitor

Without being bound by theory it is thought that the extent of individual dye fading is dependent on the light wavelength. Some dyes are photodegraded primarily by the UV component of solar radiation, for other dyes the visible component of solar radiation is the main cause of colour loss, whilst others are equally affected by both visible and UV radiation.

Protection against solar radiation can be achieved with UVA and UVB absorbing materials with high extinction coefficients. These compounds are commonly called sunscreens.

Without being bound by theory the photofading inhibitor compounds of the present invention are thought to be effective in preventing photofading of fabric due to the fact that they are at least partially water soluble and are substantive to cotton surfaces.

The photofading inhibitor of the invention comprises a compound that absorbs UV. The molecule may absorb UVA and UVB radiation. The photofading inhibitor is cationic in nature. It is preferable if the photofading inhibitor has the general formula:

Formula II

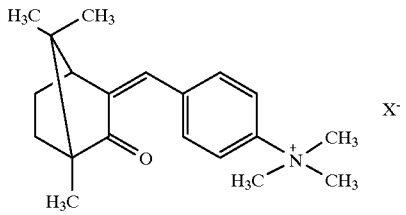

wherein $X^-$ represents the following counter ions, alkyl sulphates such as methylsulphate or ethylsulphate; alkyl alkyl sulphates, such as methylmethasulphate; and alkyl aryl sulphonates such as p-toluenesulphonyl (tosyl) and halides such as chloride. It is particularly preferred if $X^-$ is methyl sulphate.

It is advantageous if the level of cationic sunscreen is from 0.01% to 10% of the total weight of the composition., preferably from 0.05% to 5%.

The Surfactant

Compositions of the invention contain anionic surfactants. In this respect the present invention is particularly advantageous in that the anionic surfactant aids deposition of the sunscreen. This effect is particularly pronounced on dyed fabric.

Suitable anionic surfactants are well-known to those skilled in the art and include alkylbenzene sulphonate primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; ether carboxylates; isothionates; sarcosinates and fatty acid ester sulphonates, Sodium salts are generally preferred. The most preferred surfactants are primary alkyl benzene sulphonates and secondary alkyl sulphonates, particularly C8–C16 primary alkyl sulphonates, primary alkylsulphates, particularly C8–C16 primary alkyl sulphates, alkyl ether sulphates, particularly C12–C18 alkyl ether sulphates, olefin sulphonates particularly C16–C18 alpha olefin sulphonates.

It is preferred if the level of anionic surfactant is from 2 wt % to 50 wt %, preferably from 10 wt % to 35 wt % of the total product.

Further advantages of using the anionic surfactant is that higher foam levels are achieved and better solubilisation of proteinaceous soils during the cleaning of laundry.

Compositions according to the invention may also contain a cationic surfactant, a nonionic surfactant, or a zwitterionic compound.

It is preferred if compositions of the invention include a nonionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred that the ratio of anionic surfactant to nonionic surfactant is from 1:0 to 99:1, preferably from 2:1 to 1:2.

If present it is preferred that the cationic surfactant is as described our co-pending British application GB 9610865.9.

The choice of detergent-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

Detergent compositions suitable for use in most automatic fabric washing machines generally contain anionic non-soap surfactant, or nonionic surfactant, or combinations of the two in any ratio, optionally together with soap.

For compositions in solid form, especially powder, the detergent surfactant is advantageously solid at room temperature as this provides crisp composition particles.

The compositions of the invention may contain a cationic compound. Most preferred are quaternary ammonium compounds.

Detergency Builder

The detergent compositions of the invention may also contain one or more detergency builders. The total amount of detergency builder in the compositions will suitably range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst).

Inorganic phosphate builders, for example, sodium orthophosphate, pyrophosphate and tripolyphosphate are especially suitable for use with this invention.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula:

$$0.8\text{–}1.5\ Na_2O.Al_2O_3.\ 0.8\text{–}6SiO_2$$

These materials contain some bound water and are required to have a calcium ion exchange capacity of at least 50 mg CaO/g. The preferred sodium aluminosilicates contain $1.5\text{–}3.5SiO_2$ units (in the formula above). Both the amorphous and the crystalline materials can be prepared readily by reaction between sodium silicate and sodium aluminate, as amply described in the literature Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Bleach Components

Detergent compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %.

The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernonanoic acid precursors. Especially preferred bleach precursors suitable for use in the present invention are N,N,N',N'-tetracetyl ethylenediamine (TAED) and sodium nonanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. Examples of such peracids can be found in U.S. Pat. No. 4,686,063 and U.S. Pat. No. 5,397,501 (Unilever). A preferred example is the imido peroxycarboxylic class of peracids described in EP A 325 288, EP A 349 940, DE 382 3172 and EP 325 289. A particularly preferred example is phthalimido peroxy caproic acid (PAP). Such peracids are suitably present at 0.1–12%, preferably 0.5–10%.

A bleach stabiliser (heavy metal sequestrant) may also be present. Suitable bleach stabilisers include ethylenediamine tetraacetate (EDTA), the polyphosphonates such as Dequest (Trade Mark) and non-phosphate stabilisers such as EDDS (ethylene diamine di-succinic acid). These bleach stabilisers are also useful for stain removal, especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

The Enzyme

The compositions of the invention may contain an Enzyme. Preferred enzymes include the proteases, amylases, cellulases, oxidases, and peroxidases usable for incorporation in detergent compositions.

Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Detergency enzymes are commonly employed in granular form in amounts of from about 0.1 to about 3.0 wt %.

Other ingredients

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate polymer, or sodium silicate.

One preferred powder structurant is fatty acid soap, suitably present in an amount of from 1 to 5 wt %.

Other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; coloured speckles; perfumes; foam controllers; fabric softening compounds, fluorescers and decoupling polymers. This list is not intended to be exhaustive.

It is preferred if formulations of the invention contain soil release polymer. Particularly preferred soil release polymers are described in U.S. Pat. No. 3,557,039 (ICI), EP 1305A (Procter and Gamble) and EP 357 280 A (Procter and Gamble). It has been found that the soil release polymers disclosed in WO 95/32997A (Rhone-Poulenc) are particularly beneficial.

In the context of the present invention it is also advantageous if the composition further comprises an antidye transfer agent. Suitable antidye transfer agents polymeric in nature, especially preferred antidye transfer agents are described in EP 0 635 566 (Procter and Gamble) and EP 664 333 (Procter and Gamble)

If a detergent composition, the detergent composition when diluted in the wash liquor (during a typical wash cycle) will give a pH of the wash liquor from 7 to 10.5.

The components of the present invention may be incorporated in detergent compositions of all physical types, for example, powders, liquids, gels and solid bars.

Compositions of the invention may be prepared by any suitable method.

Particulate compositions are suitably prepared by spray-drying a slurry of compatible heat-insensitive ingredients, and then spraying on or postdosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l.

Especially preferred compositions have bulk densities of at least 650 g/litre, more preferably at least 700 g/litre.

Such powders may be prepared either by post-tower densification of spray-dried powder, or by wholly non-tower methods such as dry mixing and granulation; in both cases a high-speed mixer/granulator may advantageously be used.

Processes using high-speed mixer/granulators are disclosed, for example, in EP 340 013A, EP 367 339A, EP 390 251A and EP 420 317A (Unilever).

Liquid compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent or softening active.

The fabric treatment composition may also be in the form of a bar or a paste.

The invention will now be illustrated with reference to the following non-limiting Examples.

Comparative examples are illustrated by a letter and Examples of the invention are illustrated by a number.

Testing Methodology

Isothermal washes were carried out in a Tergotometer at 25° C., 40° C. and 60° C. with a liquor to cloth ratio of 25:1. The load composed of pieces of desized non fluorescent cotton dyed with Levafix turquoise blue, Cibacron red, (both trade names).

All washes were carried out in 1.14 g/l borax buffer. For wash systems containing surfactant the total surfactant concentration was 1 g/l. The sunscreen concentration was 0.04 mMoles/l.

The surfactants used in the examples quoted were:

| | |
|---|---|
| Synperonic A7 | = $C_{11-13}$ alcohol ethoxylate with a mean ethylene oxide chain length of 7 |
| Coco PAS | = Coconut primary alcohol sulphate |
| Petrelab 550 | = $C_{10-14}$ alkyl benzene sulphonate (LAS) |
| C9 LAS | = linear alkyl benzene sulphonate containing 97.4% nonyl benzene sulphonate sodium salt. |

The sunscreen used was 4-[(2-oxo-3-bornyl-idene)-methyl]-phenyl-trimethyl-ammonium methyl sulphate of formula II described above.

The level of sunscreen deposited was monitored by extraction of 2"×4" pieces of fabric with 20 ml of methyl alcohol. The piece of fabric was placed in a sample vial, the methyl alcohol added, and the vial rolled on a Luckam Multimix Major roller mixer for more than 5 hours. The UV spectrum of the extract was monitored at the max Of the sunscreen using a Perkin Elmer Lambda 16 UV/visible spectrometer, and the level of sunscreen calculated by comparison with the absorption of standard sunscreen solutions.

| | |
|---|---|
| Example A | Sunscreen only |
| Example B | Sunscreen and nonionic surfactant (Synperonic A7) |
| Example 1 | Sunscreen and anionic surfactant (Petrelab 550) |
| Example 2 | Sunscreen and a 1:1 ratio of anionic surfactant Petrelab 550 / non-ionic surfactant Synperonic A7 |
| Example 3 | Sunscreen and Coco primary alcohol sulphate (PAS) |
| Example 4 | Sunscreen and a 1:1 ratio of PAS + Synperonic A7 |
| Example 5 | Sunscreen and C9 LAS |
| Example 6 | Sunscreen and a 1:1 ratio of anionic surfactant C9 LAS / non-ionic surfactant Synperonic A7 |

Table 1 demonstrates that the deposition of the sunscreen on cotton in the presence of anionic surfactants is similar to the values obtained in the presence of non-ionic and to the values obtained in the absence of surfactant. Furthermore in some instances the anionic surfactant aids the deposition of the sunscreen onto the cotton.

TABLE 1

Deposition of sunscreen (% by wt) on cotton dyed with Cibacron red and Levafix turquoise blue.

| | DEPOSITION % ON COTTON | | | | | |
|---|---|---|---|---|---|---|
| | Cibacron Red | | | Levafix Turquoise Blue | | |
| Example | 24° C. | 40° C. | 60° C. | 24° C. | 40° C. | 60° C. |
| A | 12.5 | 17.6 | 17 | 12.3 | 14.9 | 16.1 |
| B | 12.1 | 7.9 | 9.1 | 11.7 | 12.8 | 11.6 |
| 1 | 15.3 | 10.7 | 11.1 | 10.7 | 10.3 | 12.6 |
| 2 | 10.5 | 8.9 | 11.2 | 12.1 | 10.6 | 7.2 |
| 3 | 11.9 | 10.0 | 12.3 | 11.2 | 12.5 | 11.4 |
| 4 | 11.0 | 9.5 | 10.8 | 10.5 | 10.5 | 11.7 |
| 5 | 21.6 | 26.1 | 20.7 | 28.2 | 20.3 | 31.6 |
| 6 | 13.1 | 10.1 | 9.5 | 11.4 | 10.6 | 8.6 |

Further experiments were undertaken to show the effect of protection given to the underlying skin by the adsorption of UV absorbing materials onto fabrics.

Clothing is known to give some protection from the effect of sunlight induced skin cancers. The adsorption of UV absorbing materials onto fabrics further reduces the transmission of UV rays thus increasing the protection given to underlying skin.

The UV protection given by fabrics (UPF) is monitored instrumentally as the transmission of UV light through a fabric over the wavelength range 290–400 nm. These measurements are weighted to take into account the erythemal damage which occurs at each wavelength, and the intensity of the solar spectrum at each wavelength. UPF is numerically equal to the in-vivo derived sun protection factor (SPF) used to indicate the protection factor (SPF) used to indicate the protection conferred by "sun tan" lotions.

The following table shows that the level of UPF protection is increased with washing fabrics in surfactant containing the sunscreen of the present invention. The particular sunscreen used in this experiment was 4-[(2-oxo-3-bornyl-idene)-methyl]-phenyl trimethyl-ammonium methyl sulphate of formula II described above. The surfactants used were:

Petrelab 550=$C_{10-14}$ alkyl benzene sulphonate (LAS)

STP=sodium tripolyphosphate ($Na_6P_3O_{10}$)

Measurement of white cotton sheeting after four wash cycles shows that the level of protection increased with sunscreen containing washes.

| Wash System | UPF |
|---|---|
| 1. Demin Water control | 4.9 |
| 2. LAS + STP control | 4.4 |
| 3. System 2 + 0.04 mM sunscreen | 13.2 |
| 4. System 2 + 0.08 mM sunscreen | 19.6 |
| 5. System 2 + 0.1 mM sunscreen | 21.8 |

The UPF of the cotton sheeting was increased from an initial value of ~5 to 13–21 for the three systems containing sunscreens at varying concentrations.

The National Radiological Protection Board in the UK consider garments with a UPF in the range 10–20 to give high protection and those with a UPF of 20–29 to give very high protection.

As the preferred sunscreen of the present invention has its adsorption peak within the skin damaging UVB region at 288 nm, the fabric treated with the said sunscreen protects the skin from damaging UVB rays.

We claim:

1. A method of preventing the photofading of fabric comprising the step of treating the fabric with a composition containing a cationic sunscreen having the general formula:

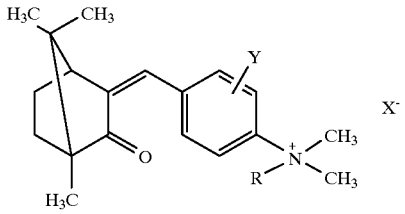

wherein R represents a hydrogen atom or an alkyl group containing 1 to 12 carbon atoms and Y represents a halogen atom, a methyl group or a hydrogen atom and $X^-$ represents any suitable counter-ion.

2. A method of protecting skin from UV rays comprising the step of treating fabric with a composition containing a sunscreen having the general formula:

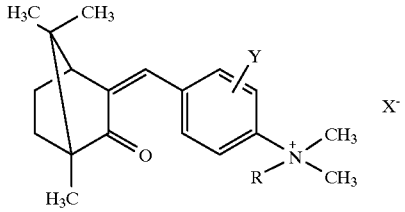

and covering the skin with the treated fabric, so that skin covered by said fabric is protected from UV rays.

* * * * *